US007672616B2

(12) United States Patent
Fujita

(10) Patent No.: US 7,672,616 B2
(45) Date of Patent: Mar. 2, 2010

(54) TONER USAGE CONTROL BETWEEN DIFFERING IMAGE REGIONS

(75) Inventor: Hideki Fujita, Moriya (JP)

(73) Assignee: Canon Kabushiki Kaisha (JP)

( * ) Notice: Subject to any disclaimer, the term of this patent is extended or adjusted under 35 U.S.C. 154(b) by 267 days.

(21) Appl. No.: 11/839,438

(22) Filed: Aug. 15, 2007

(65) Prior Publication Data

US 2008/0050136 A1 Feb. 28, 2008

(30) Foreign Application Priority Data

Aug. 24, 2006 (JP) ..... 2006-228344

(51) Int. Cl.
*G03G 15/01* (2006.01)
*G03G 15/08* (2006.01)

(52) U.S. Cl. ..... 399/223; 399/53

(58) Field of Classification Search ..... 399/6, 399/38, 51, 53, 130, 156, 157, 182, 194, 399/222, 223; 347/129
See application file for complete search history.

(56) References Cited

U.S. PATENT DOCUMENTS 5,835,819 A * 11/1998 Yamamoto ..... 399/51
2006/0140651 A1* 6/2006 Hirobe et al. ..... 399/223 X

FOREIGN PATENT DOCUMENTS

| | | | |
|---|---|---|---|
| JP | 5-35038 | A | 2/1993 |
| JP | 10-198137 | A | 7/1998 |
| JP | 2000-231279 | A | 8/2000 |
| JP | 2000-347476 | A | 12/2000 |
| JP | 2001-290319 | A | 10/2001 |
| JP | 2003-89238 | A | 3/2003 |

* cited by examiner

*Primary Examiner*—Sandra L Brase
(74) *Attorney, Agent, or Firm*—Rossi, Kimms & McDowell LLP

(57) ABSTRACT

A control part provides a first region in which an image is formed on an image carrier using only a dark-color toner. The control part provides a second region, which is adjacent to the first region, in which an image is formed using a dark-color toner and a light-color toner. The control part provides a third region in which an image is formed using only a light-color toner at the boundary of the first and second regions. The control part controls a latent-image forming unit, a light-color developing unit and a dark-color developing unit so as to form an image in which these regions are provided. The control part may provide a third region in which neither a light-color toner nor a dark-color toner is used at the boundary of the first and second regions.

12 Claims, 9 Drawing Sheets

TONER USAGE CONTROL BETWEEN DIFFERING IMAGE REGIONS

BACKGROUND OF THE INVENTION

1. Field of the Invention

The present invention relates to an image forming apparatus, which uses dark-color and light-color developer materials, and to a method of controlling this apparatus.

2. Description of the Related Art

There is growing demand for further improvements in image quality in recent models of electrophotographic-type image forming apparatus. In particular, there is demand for the ability to faithfully reproduce photographs and security-patterns (which prevent unauthorized copying), etc., in addition to the usual text and graphs, on a printing medium. Although text requires a high resolution and photographs and security-patterns require rich tonality, it is difficult to satisfy both requirements simultaneously in the prior art.

In order to satisfy these requirements, inventions that make joint use of light-color toner and dark-color toner have been proposed (Japanese Patent Laid-Open Nos. 5-35038, 2000-231279, 2000-347476 and 2001-290319).

An electrophotographic image forming apparatus is not only capable of forming patterns on plain paper but can also form security-patterns and other images (text, lines and photographs, etc.) on plain paper.

When an image that has a mixture of a text/line region or equal-density large-area region, a photographic region and a security-pattern region is formed, a problem in image quality arises in an adjacent region, namely a region in which these different types of regions are adjacent to each other. It should be noted that an equal-density large-area region refers to a region in which the same pixel continues for at least a prescribed number of pixels in the laser scanning direction and for at least a prescribed number of pixels in the direction perpendicular to the laser scanning direction. For example, in case of a resolution of 600 dpi, a region (2.15 mm×2.15 mm) in which the same pixel continues for 50 or more pixels in the laser scanning direction and 50 or more pixels in the direction perpendicular to the laser scanning direction is an equal-density large-area region.

In order to develop a security-pattern, which must not be conspicuous, using a dark-color toner, it is necessary to reduce the size of one dot. In view of the characteristics of electrophotography, however, the reproducibility of one dot declines in this case and the size of a single dot tends to fluctuate. This results in the occurrence of unevenness in the security-pattern region.

On the other hand, it has also been considered to form one dot of a security-pattern in the maximum size and with a light-color toner. If the security-pattern and text/line region or equal-density large-area region are adjacent in this case, it is difficult to distinguish between the two (see FIG. 4). Further, it has been considered to form part of a photographic region using a light-color toner. If the photographic region and a text/line region or equal-density large-area region are adjacent in this case, it is difficult to distinguish between the two (see FIG. 5).

The specification of Japanese Patent Laid-Open No. 10-198137 proposes a method in which when a high-contrast image and a low-contrast image are formed adjacent to each other using a single developer, a white streak that occurs on the low-contrast side of the boundary is prevented. Specifically, an unexposed region is provided at a boundary that exists between a solid portion and a halftone portion. Since the unexposed region functions as a potential wall, white streaks can be prevented.

The specification of Japanese Patent Laid-Open No. 2003-089238 proposes a method of correcting image data, which corresponds to the edge portions of images, in order to prevent white streaks. It should be noted that the inventions described in the specifications of Japanese Patent Laid-Open Nos. 10-198137 and 2003-089238 are directed to problems relating to a single developer and are not directed to problems relating to developers of different densities belonging to the same hue.

SUMMARY OF THE INVENTION

Accordingly, an object of the present invention is to improve image quality in a region (boundary area) where different types of objects are adjacent to each other in an image having a mixture of a text/line region or equal-density large-area region, a photographic region and a security-pattern region.

The present invention can be implemented as an image forming apparatus or as a method of controlling this apparatus. The image forming apparatus includes a latent-image forming unit for forming a latent image on an image carrier; a light-color developing unit (first developing unit) for developing the latent image by a light-color toner; and a dark-color developing unit (second developing unit) for developing the latent image by a toner having an optical density higher than that of the light-color toner.

By way of example, a control part provides a first region in which an image is formed on an image carrier using a dark-color toner but not a light-color toner. The control part provides a second region in which an image is formed using a dark-color toner and a light-color toner. The control part provides a third region in which an image is formed using a light-color toner but not a dark-color toner at a boundary between the first and second regions. The control part controls the latent-image forming unit, light-color developing unit and dark-color developing unit in such a manner that an image having each of these regions is formed.

It should be noted that the control part may provide a third region in which neither the light-color toner nor dark-color toner are used at the boundary between the first and second regions.

Further features of the present invention will become apparent from the following description of exemplary embodiments with reference to the attached drawings.

DESCRIPTION OF THE EMBODIMENTS

Embodiments of the present invention will now be described. Of course, the individual embodiments described below are useful in understanding various concepts such as higher-order, intermediate-order and lower-order concepts of the invention. Further, the technical scope of the present invention is determined by the scope of the claims and is not limited by the individual embodiments below.

Figure 1:
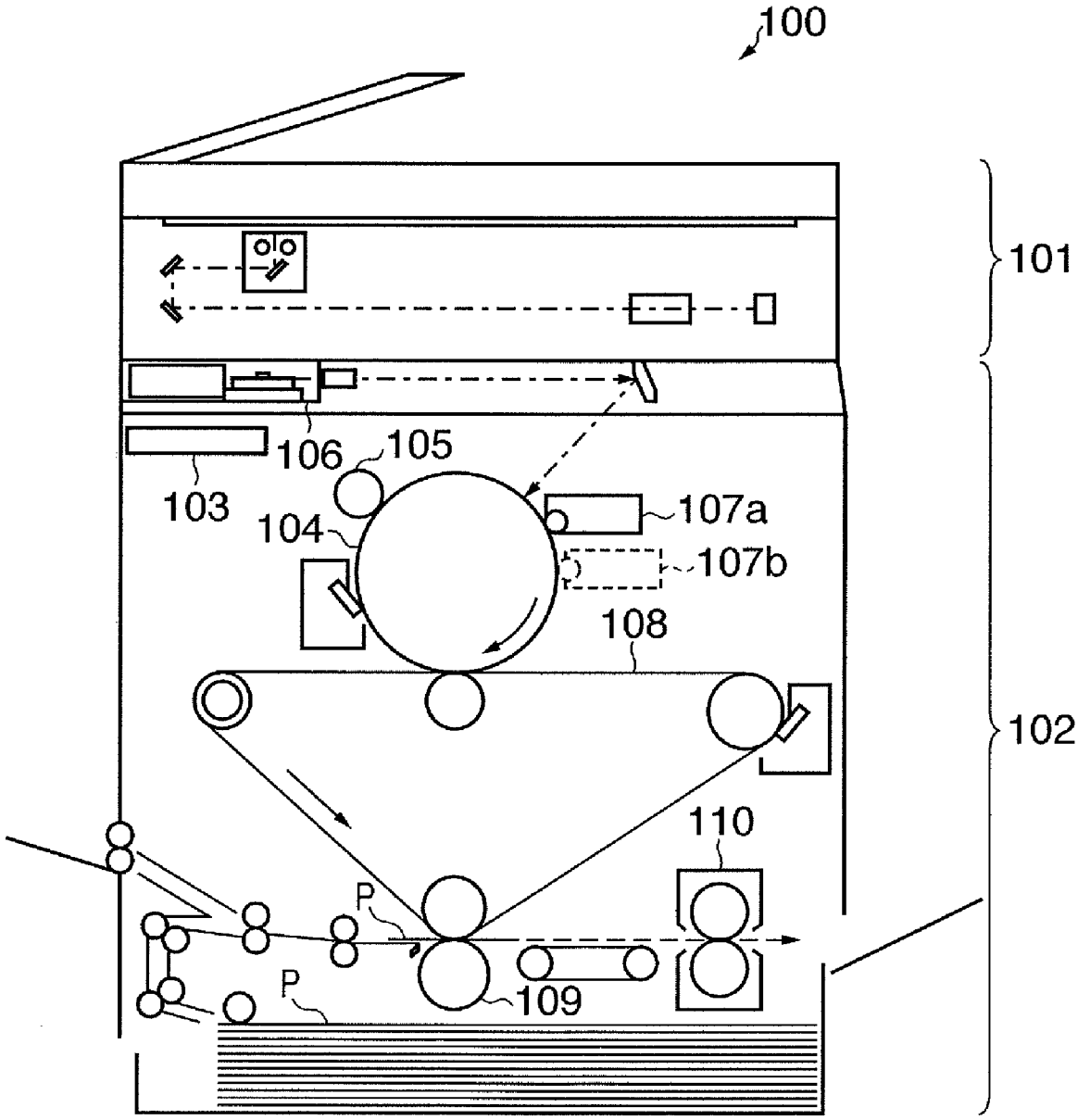
FIG. 1 is a sectional view illustrating an image forming apparatus according to an embodiment of the present invention.

FIG. 1 is a sectional view illustrating an image forming apparatus according to an embodiment of the present invention. As illustrated in FIG. 1, an image forming apparatus 100 includes an image reader 101, a printer engine 102 and an image processing unit 103. It should be noted that the image forming apparatus 100 may be implemented not only as a copier but also as a printer, facsimile machine or multifunction peripheral.

The image reader 101 includes a scanner unit, etc., for reading a document transported and placed on a document glass. As is well known, the scanner unit generates document image data (R, G, B luminance signals) and outputs the image data to the image processing unit 103. The image processing unit 103 converts the received image data to image data in the color space (e.g., YMCK) of a developer material, applies a tone correction and outputs the resultant data to the printer engine 102. In this embodiment, the color space of the developer material is black (K) only, although a light-color toner (first toner) and a dark-color toner (second toner) are used as developer materials.

A latent-image forming unit is implemented primarily by a photosensitive drum 104, a charging device 105 and an exposure unit 106. The photosensitive drum 104 is one example of an image carrier. The photosensitive drum 104 is charged uniformly by the charging device 105. Furthermore, a latent image is formed on the surface of the photosensitive drum 104 by a laser beam that is output from the exposure unit 106 in accordance with the image signal that is output from the image processing unit 103. The latent image is developed by a dark-color developer (second developing unit) 107*a* having dark-color toner, and a light-color developer (first developing unit) 107*b* having light-color toner.

The developed image is primary-transferred from the photosensitive drum 104 to an intermediate transfer belt 108. Furthermore, the developed image is secondary-transferred from the intermediate transfer belt 108 to a printing medium P by a secondary transfer roller 109. Finally, the developed image is subjected to heat and pressure, and fixed on the printing medium P by a fixing unit 110.

Figure 2:
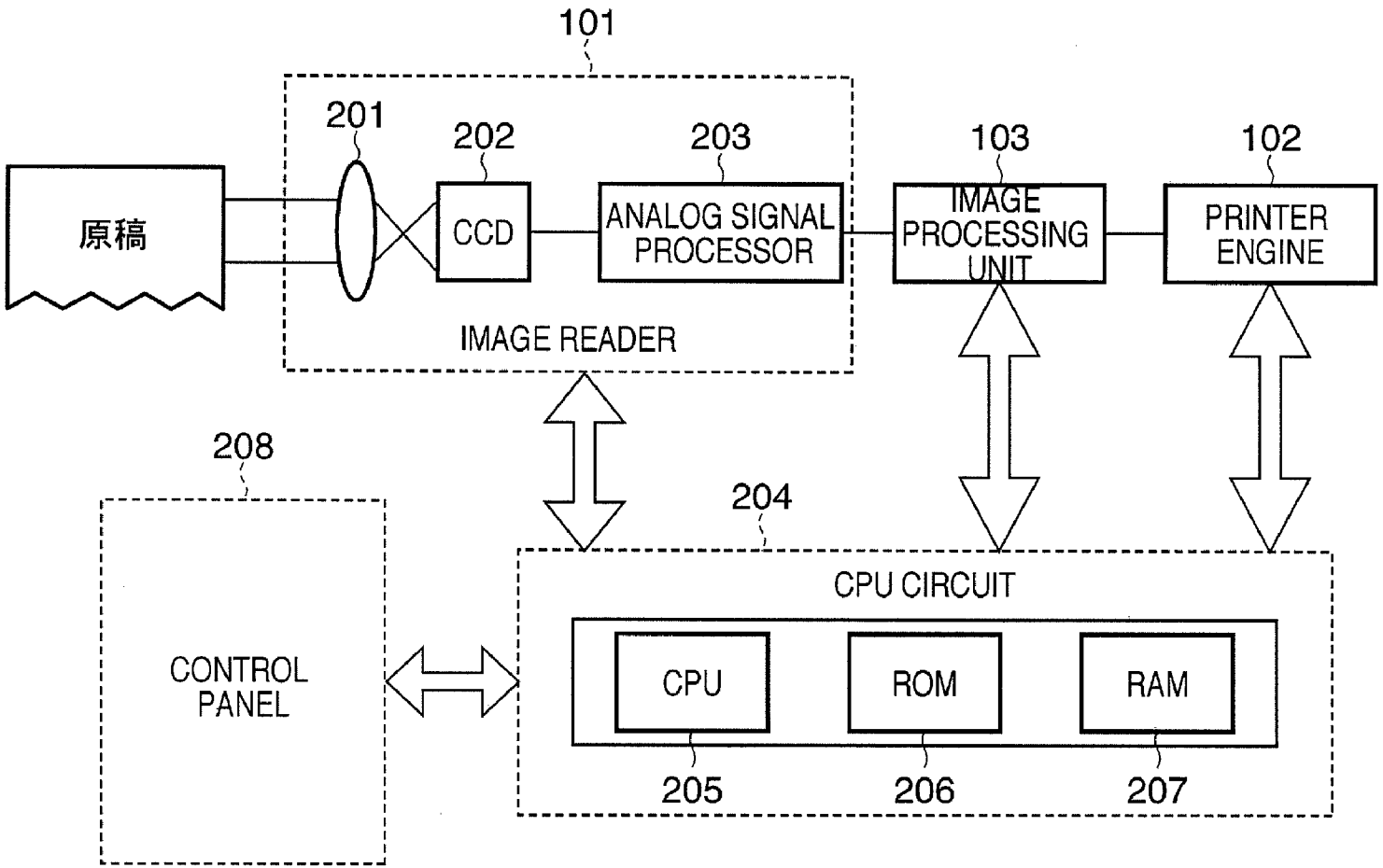
FIG. 2 is a block diagram illustrating an example of a controller according to this embodiment.

FIG. 2 is a block diagram illustrating an example of a controller according to this embodiment. The image reader 101 is constituted by a lens 201, a CCD sensor 202 and an analog signal processor 203, etc. The CCD sensor 202 converts a document image, which has been formed via the lens 201, to an analog signal. The analog signal processor 203 corrects the applied signal appropriately and subjects it to an analog-to-digital (A/D) conversion. The digital signal that has been output from analog signal processor 203 is input to the image processing unit 103.

The image processing unit 103 executes processing such as a shading correction, gamma correction, smoothing processing, edge emphasis and JPEG compression/expansion processing. The image processing unit 103 executes further processing such as processing for classifying objects (e.g., various regions such as text, lines, photographs and security-patterns), processing for identifying an adjacent region and processing for converting density in an adjacent region.

The image processing unit 103 may also function as a control part for controlling a latent-image forming unit, light-color developing unit and dark-color developing unit so as to form an image having at least three regions. The control part provides a first region in which an image is formed on an image carrier using a dark-color toner but not a light-color toner. The control part provides a second region, which is adjacent to the first region, in which an image is formed using a dark-color toner and a light-color toner. The control part provides a third region in which an image is formed using a light-color toner but not a dark-color toner at the boundary of the first and second regions. (The third region is an adjacent region, which is a boundary region.) It should be noted that the control part may provide a third region in which neither the light-color toner nor the dark-color toner is used at the boundary of the first and second regions. The light-color toner and dark-color toner belong to the same hue. Further, there may be provided a first region in which an image is formed using a dark-color toner and not a light-color toner, a second region in which an image is formed using a light-color toner but not a dark-color toner, and a third region in which a light-color toner and a dark-color toner are not used at the boundary of the first and second regions.

A CPU circuit 204 comprises a CPU 205, a ROM 206 and a RAM 207, etc. The CPU 205 controls the overall operation of the image reader 101, image processing unit 103, printer engine 102 and a control panel 208. A control program has been stored in the ROM 206, and a work area is reserved in the RAM 207. The control panel 208, which includes a touch-sensitive panel and a display unit, provides the operator with a user interface (UI). It should be noted that the CPU circuit 204 may function as the control part mentioned above.

Figure 3:
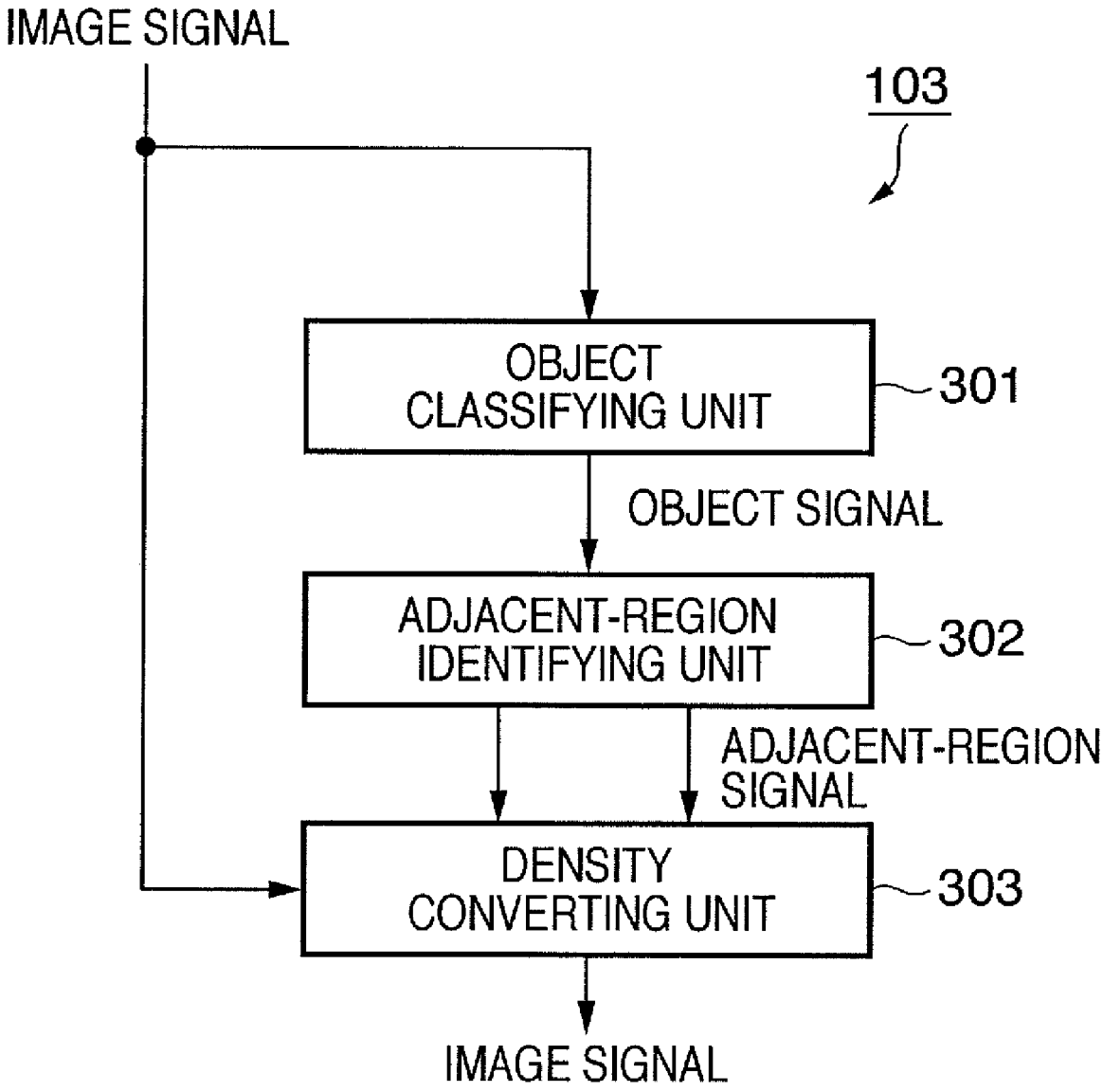
FIG. 3 is a block diagram illustrating part of an image processing unit according to this embodiment.

FIG. 3 is a block diagram illustrating part of the image processing unit according to this embodiment. An image that has been read by the image reader 101 is equivalent to bitmap data Text, fine lines, photographs and background cannot be distinguished from one another in the bitmap data.

Accordingly, an object classifying unit 301 classifies each pixel constituting an input image into a text/line region typified by text and lines, a photographic region typified by a photograph, or a security-pattern region typified by a security-pattern for preventing unauthorized copying. The security-pattern region may be called as a region where a copy-forgery-inhibited pattern image is formed. It should be noted that the text/line region may include an equal-density large-area region. As mentioned earlier, an equal-density large-area region refers to a region in which the same pixel continues for at least a prescribed number of pixels in the laser scanning direction and for at least a prescribed number of pixels in the direction perpendicular to this direction. That is, an equal-density large-area region comprises a plurality of pixels of equal density and therefore can be construed as resembling a text/line region. Accordingly, it is preferred that the object classifying unit 301 classify an equal-density large-area region as a text/line region as well.

The object classifying unit 301 outputs an object signal pixel by pixel as the result of classification processing. To which region each pixel belongs can be determined depending upon the object signal. The basic operation of the object classifying unit 301 is to generate a signal for every object, such as text information, fine-line information, halftone-dot information or photographic-paper photo information, pixel by pixel from the bitmap image data that has been read. If reference is had to the object signal, an adjacency-region identifying unit 302 is capable of discriminating whether any pixel position contained in the image is text, a photograph, etc.

With regard to each pixel, the adjacency-region identifying unit 302 identifies pixels in an adjacent region, which is a region in which at least two regions from among a text/line region, photographic region and security-pattern region are adjacent to each other. This identification processing is executed based upon the object signal. For example, assume that the object signal of a certain pixel is indicative of a text/line region. Further, assume that the object signal of a pixel that is adjacent to this pixel is indicative of a photographic region. In this case, these pixels exist in an adjacent region, which is the region in which the two different objects are adjacent to each other.

A density converting unit 303 converts the density level of pixels based upon the object signal and adjacency-region signal, by way of example. The density converting unit 303 converts the density level of a pixel in such a manner that a pixel classified as being in a text/line region is developed solely by the dark-color developer 107*a*. Further, the density converting unit 303 converts the density level of a pixel in such a manner that a pixel classified as being in a photographic region is developed by the dark-color developer 107*a* and light-color developer 107*b*. Further, the density converting unit 303 converts the density level of a pixel in such a manner that a pixel classified as being in a security-pattern region is developed solely by the light-color developer 107*b*. It goes without saying that the density converting unit 303 functions as a control unit for controlling density.

Thus, in principle each pixel of a text/line region C is exposed by the exposure unit 106 at maximum strength. Further, the dark-color developer 107*a* develops each pixel of the text/line region C (latent image) by the dark-color toner.

Further, the exposure unit 106 exposes each pixel of a photographic region P using light beam at maximum strength. Each pixel (latent image) is developed by the dark-color developer 107*a* and light-color developer 107*b* using dark-color toner and light-color toner, respectively.

Furthermore, each pixel of a security-pattern region W is exposed by the exposure unit 106 at maximum strength. The light-color developer 107*b* develops each pixel using the light-color toner.

Figure 4:
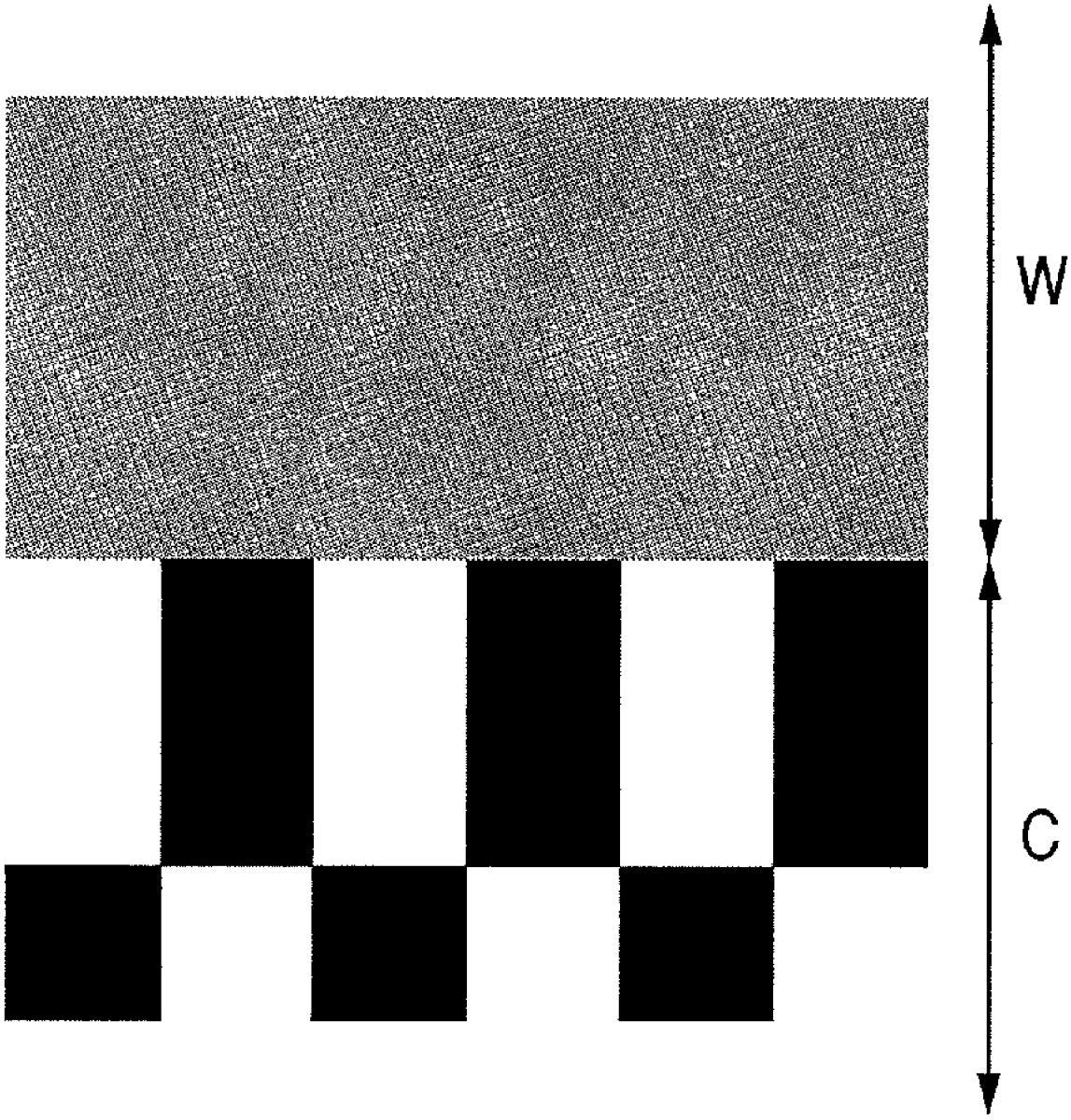
FIG. 4 is a diagram illustrating an example in which a text/line region and a security-pattern region are adjacent.

FIG. 4 is a diagram illustrating an example in which a text/line region C and a security-pattern region W are adjacent to each other. Since the text/line region C and security-pattern region W are adjacent to each other, the vicinity of the boundary between these two regions is visually ambiguous, as will be understood from FIG. 4.

Figure 5:
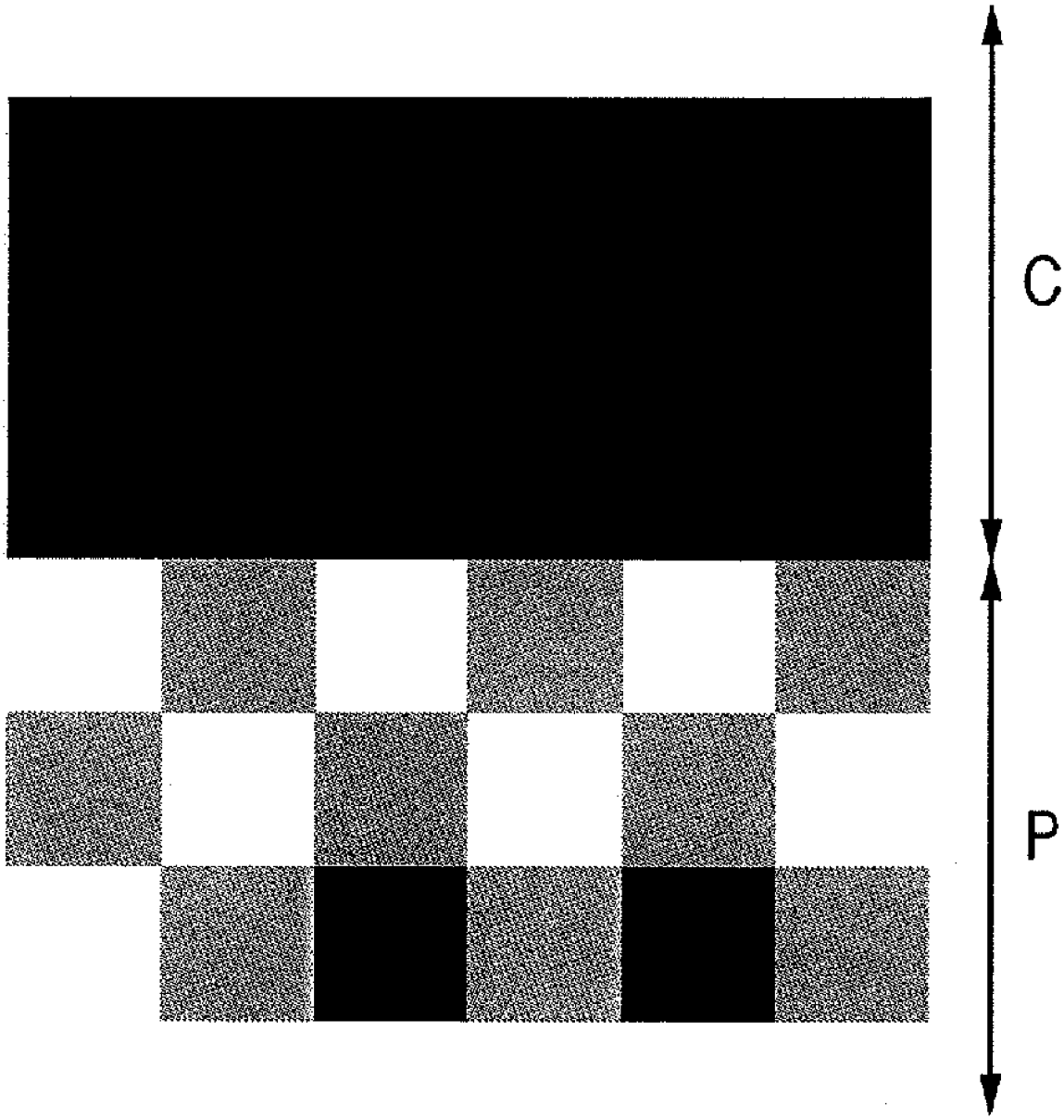
FIG. 5 is a diagram illustrating an example in which a text/line region and a photographic region are adjacent.

FIG. 5 is a diagram illustrating an example in which a text/line region C and a photographic region P are adjacent to each other. Since the text/line region C and photographic region P are adjacent to each other, the vicinity of the boundary between these two regions is visually ambiguous, as will be understood from FIG. 5.

Accordingly, with regard to each pixel of a specific adjacent region, the density converting unit 303 converts the density level of the pixel so as to form a latent image different from pixels in a non-adjacent region, which is a region in which a text/line region, photographic region and security-pattern region are not adjacent to one another.

Figure 6:
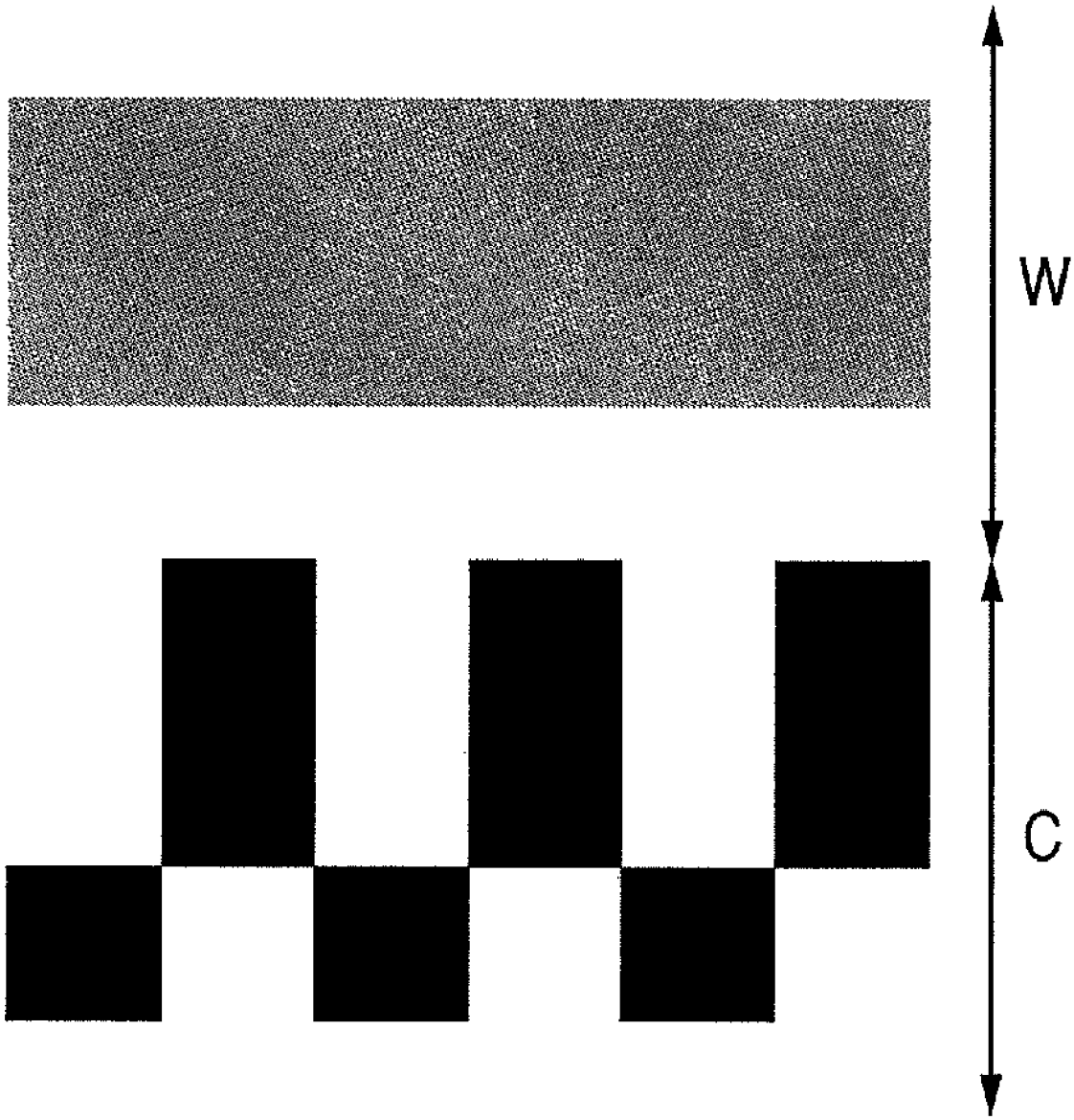
FIG. 6 is a diagram illustrating an example in which this embodiment is applied to a case where a text/line region and a security-pattern region are adjacent.

FIG. 6 is a diagram illustrating an example in which this embodiment is applied to a case where a text/line region C and a security-pattern region W are adjacent to each other. As will be understood from FIG. 6, the text/line region C and security-pattern region W are adjacent to each other. However, by forgoing the formation of one row of plurality of pixels in the security-pattern region W (i.e., by making the density level of these pixels zero), the vicinity of the boundary between these two regions becomes visually distinct. It should be noted that the plurality of pixels whose density is changed may be a single row, as illustrated in FIG. 6, or two or more rows. Further, the row of the plurality of pixels is that situated at the extreme edge of the region.

Figure 7:
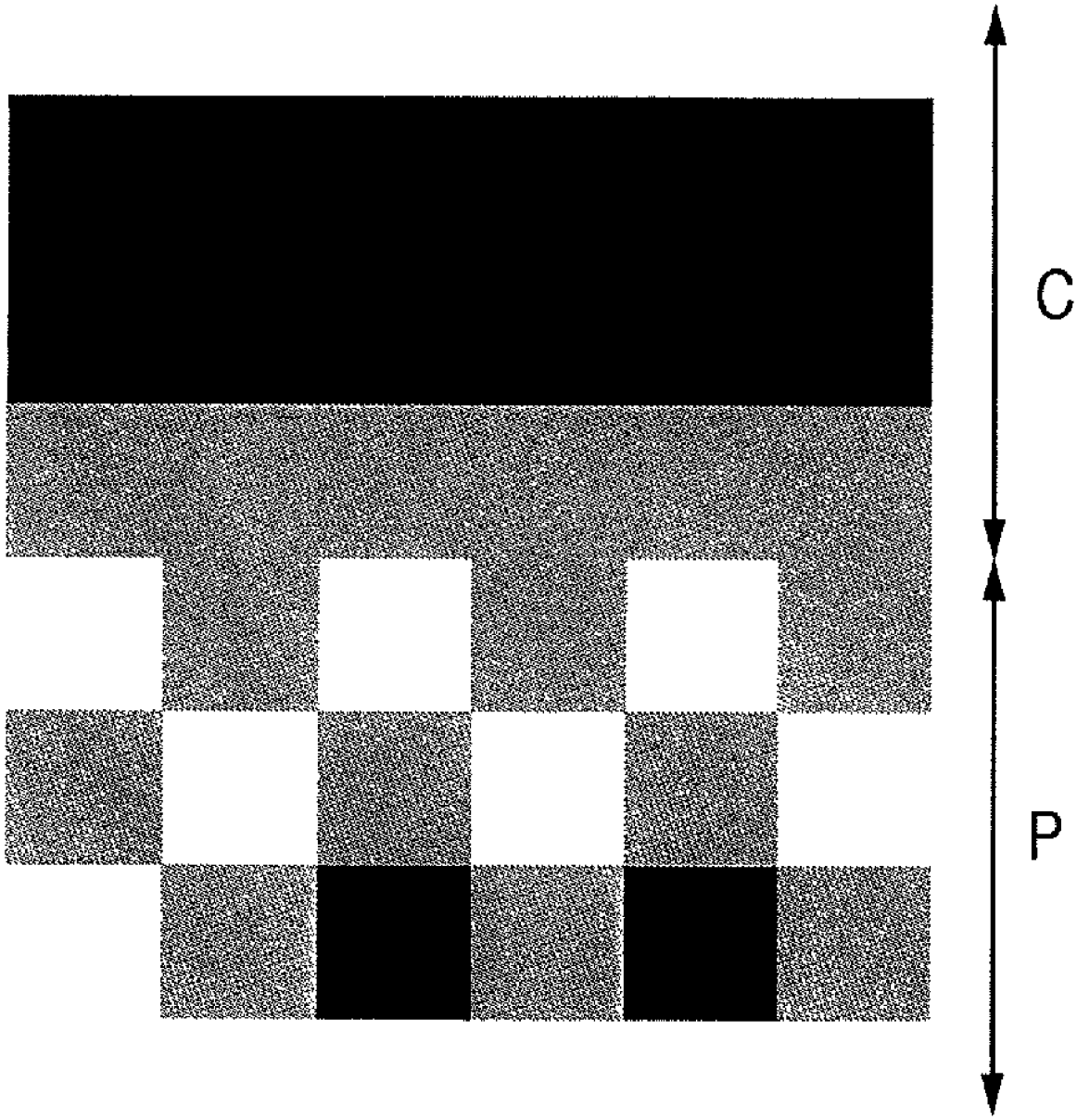
FIG. 7 is a diagram illustrating an example in which this embodiment is applied to a case where a text/line region and a photographic region are adjacent.

FIG. 7 is a diagram illustrating an example in which this embodiment is applied to a case where a text/line region C and a photographic region P are adjacent to each other. As will be understood from FIG. 7, the text/line region C and photographic region P are adjacent to each other. However, by using light-color toner to form a row of a plurality of pixels constituting the text/line region C, the vicinity of the boundary between the two regions becomes visually distinct. It should be noted that the plurality of pixels formed by the light-color toner may be a single row, as illustrated in FIG. 7, of two or more rows. Further, the row of the plurality of pixels is that situated at the extreme edge of the region.

Thus, in a case where the text/line region C is of intermediate density and is adjacent to the security-pattern region W, the two can be prevented from being difficult to distinguish from each other. Further, also in a case where part of the photographic region P is formed by the light-color toner and the photographic region P is adjacent to the text/line region C, the two can be prevented from being difficult to distinguish from each other.

In the example described above, the image portion is exposed. However, what is exposed may just as well be the background portion. The basic technical idea is unchanged.

The light-color toner is toner so designed that the optical density thereof after fixation will be 0.8 when the amount of toner on the printing medium is 0.5 mg/cm$^2$, by way of example. On the other hand, the dark-color toner is toner so designed that the optical density thereof after fixation will be 1.6 when the amount of toner on the printing medium is 0.5 mg/cm$^2$, by way of example. It should be noted that the light-color toner may be toner in which the pigment has been adjusted in such a manner that the optical density will be less than 1.0 when the amount of toner on the printing medium is 0.5 mg/cm$^2$. The dark-color toner may be toner in which the pigment has been adjusted in such a manner that the optical density will be less than 1.0 or greater when the amount of toner on the printing medium is 0.5 mg/cm$^2$.

Figure 8:
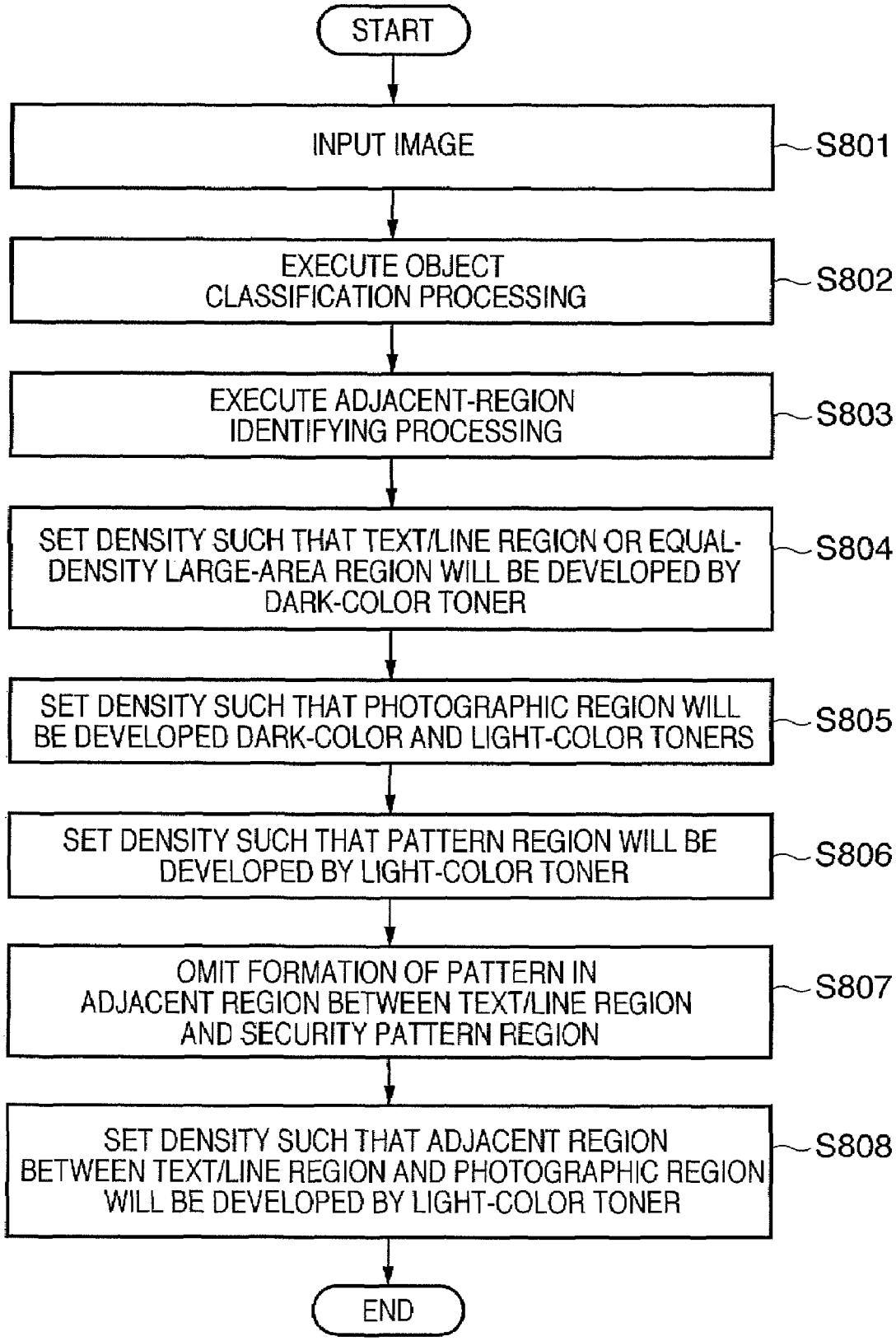
FIG. 8 is a flowchart illustrating an example of a method of controlling the image forming apparatus according to this embodiment.

FIG. 8 is a flowchart illustrating an example of a method of controlling the image forming apparatus according to this embodiment. At step S801, the image of a document read by the image reader 101 is input to the image processing unit 103.

Next, at step S802, the object classifying unit 301 of the image processing unit 103 classifies each pixel constituting the entered image into a text/line region typified by text and lines, a photographic region typified by a photograph, or a security-pattern region typified by a security-pattern. It should be noted that the object classifying unit 301 may also classify an equal-density large-area region into a text/line region.

At step S803, with regard to each classified pixel, the adjacency-region identifying unit 302 identifies pixels in an adjacent region, which is a region in which at least two regions from among a text/line region, photographic region and security-pattern region are adjacent to each other.

At step S804, the density converting unit 303 sets the density of pixels, which have been classified into a text/line region, in such a manner that these pixels will be developed by the dark-color developer 107*a*.

At step S805, the density converting unit 303 sets the density of pixels, which have been classified into a photographic region, in such a manner that these pixels will be developed by the dark-color developer 107*a* and light-color developer 107*b*.

At step S806, the density converting unit 303 sets the density of pixels, which have been classified into a security-pattern region, in such a manner that these pixels will be developed by the light-color developer 107*b*.

At steps S807 and S808, with regard to pixels in an adjacent region, the density converting unit 303 sets density so as to form a latent image that differs from that of pixels in a non-adjacent region. At step S807, for example, the density converting unit 303 sets the density of the pixels in such a manner that the image of a pattern will not be formed in an adjacent region where a text/line region and the security-pattern region are adjacent to each other. At step S808, the density converting unit 303 sets the density of the pixels in an adjacent region, in which the text/line region and photographic region are adjacent to each other, in such a manner that these pixels will be developed by the light-color developer 107*b*.

It should be noted that pixels in an adjacent region between a security-pattern region and a photographic region may be handled in a manner similar to pixels in an adjacent region between a text/line region and photographic region.

Figure 9:
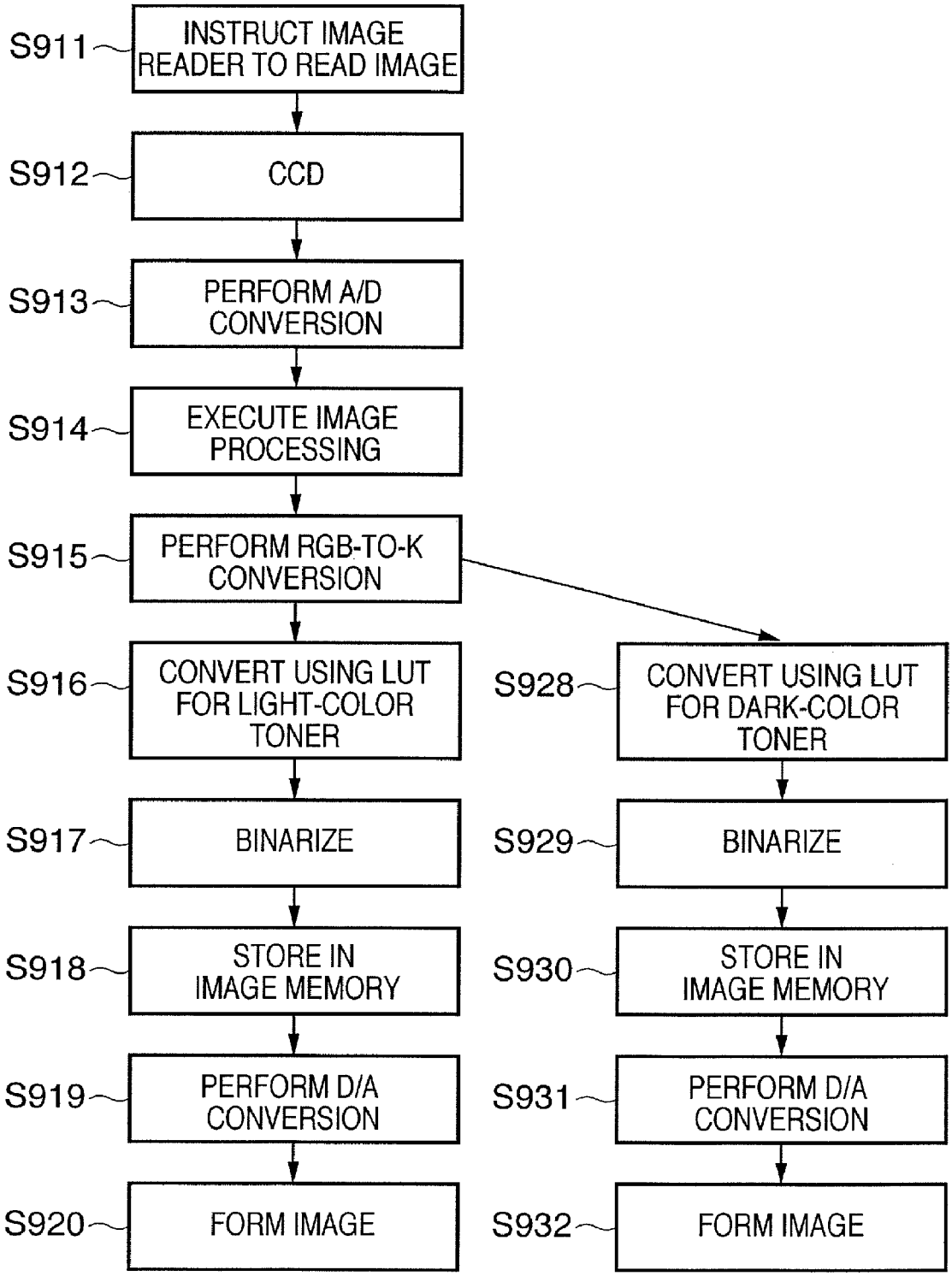
FIG. 9 is a flowchart illustrating another example of a method of controlling the image forming apparatus according to this embodiment.

FIG. 9 is a flowchart illustrating another example of a method of controlling the image forming apparatus according to this embodiment. At step S911, the CPU 205 instructs the image reader 101 to read the image of a document. Next, at step S912, the image reader 101 reads the image of the document using the CCD sensor 202 in response to the read instruction. At step S913, the analog signal processor 203 converts the analog signal of the image to a digital RGB signal and outputs the digital signal to the image processing unit 103. Steps S911 to S913 correspond to step S801 described above.

At step S914, the image processing unit 103 applies prescribed image processing to the RGB signal input thereto. Here the above-described steps S803 and S804 are executed.

At step S915, the image processing unit 103 converts the RGB signal to a K signal. From this point onward, processing differs depending upon the type of object. Steps S928 to S932 are applied to pixels classified as being in a text/line region; steps S916, S917 and steps S928 to S932 are applied to pixels classified as being in photographic region; and steps S916, S917 are applied to pixels classified as being in security-pattern region.

At step S916, the density converting unit 303 converts the density of pixels in a photographic region and security-pattern region using a look-up table (referred to as a "LUT" below) for a light-color toner. At this time the density converting unit 303 sets density so as to form latent images that differ between an adjacency region and a non-adjacency region.

At step S917, the image processing unit 103 executes binarization processing. At step S918, the image processing unit 103 stores the binarized image signal in an image memory. Next, at step S919, the image processing unit 103 converts the image signal to an analog image signal and outputs this signal to the printer engine 102. At step S920, the printer engine 102 forms a latent image in accordance with the image signal, develops the latent image using the light-color developer 107*b* and transfers the developed image to the printing medium.

At step S928, the density converting unit 303 converts the density of the pixels in the photographic region and text/line region using a LUT for dark-color toner. At this time the density converting unit 303 sets density so as to form latent images that differ between an adjacency region and a non-adjacency region.

At step S929, the image processing unit 103 executes binarization processing. At step S930, the image processing unit 103 stores the binarized image signal in an image memory. Next, at step S931, the image processing unit 103 converts the image signal to an analog image signal and outputs this signal to the printer engine 102. At step S932, the printer engine 102 forms a latent image in accordance with the image signal, develops the latent image using the dark-color developer 107*a* and transfers the developed image to the printing medium.

Thus, in accordance with this embodiment, special consideration is given to the formation of pixels in an adjacent region. As a result, the image quality of a region in which different types of objects are adjacent to each other can be improved even with regard to an image that is a mixture of a text/line region or equal-density large-area region, photographic region and security-pattern region.

It should be noted that by handling an equal-density large-area region in the same manner as a text/line region, it is possible to improve the image quality of a region in which an equal-density large-area region and another type of region are adjacent to each other.

In particular, it is easy to improve image quality by exercising control so as not to form an image of a security-pattern in an adjacency region in which a text/line region and a security-pattern region are adjacent to each other.

Further, if an adjacent region in which a text/line region and a photographic region are adjacent to each other is developed by a light-color developer material, it is easy to improve image quality While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2006-228344, filed Aug. 24, 2006, which is hereby incorporated by reference herein in its entirety.

What is claimed is:

1. An image forming apparatus comprising:

an image carrier configured to carry an image;

a latent-image forming unit configured to form a latent image on said image carrier;

a first developing unit configured to develop the latent image by a first toner;

a second developing unit configured to develop the latent image by a second toner which is of the same hue as that of the first toner and has a higher optical density than that of the first toner; and a control part configured to control said first and second developing units so as to form a first region, a second region and a third region on said image carrier, wherein the first region is one in which the second toner is used but the first toner is not used, the second region is one in which the first and second toners are used, and the third region is one in which at a boundary of the first and second regions, the first toner is used but the second toner is not used.

2. The apparatus according to claim 1, wherein the first region is a text/line region typified by text or a line, and the second region is a photographic region typified by a photograph.

3. The apparatus according to claim 2, wherein the first region includes also an equal-density large-area region comprising a plurality of pixels of equal density.

4. A method of controlling an image forming apparatus that includes:

an image carrier configured to carry an image;

a latent-image forming unit configured to form a latent image on said image carrier;

a first developing unit configured to develop the latent image by a first toner;

a second developing unit configured to develop the latent image by a second toner which is of the same hue as that of the first toner and has a higher optical density than that of the first toner;

said method comprising the step of controlling the latent-image forming unit and the first and second developing units so as to form an entered image by providing a first region, a second region and a third region on said image carrier, wherein the first region is one in which the second toner is used but the first toner is not used, the second region is one in which the first and second toners are used, and the third region is one in which at a boundary of the first and second regions, the first toner is used but the second toner is not used.

5. An image forming apparatus comprising:

an image carrier configured to carry an image;

a latent-image forming unit configured to form a latent image on said image carrier based upon image information;

a first developing unit configured to develop the latent image by a first toner;

a second developing unit configured to develop the latent image by a second toner which is of the same hue as that of the first toner and has a higher optical density than that of the first toner; and a control part configured to control said first and second developing units so as to form a first region, a second region and a third region on said image carrier, wherein the first region is one in which the second toner is used but the first toner is not used, the second region is one in which the first and second toners are used, and the third region is one in which at a boundary of the first and second regions, neither the first toner nor the second toner is used.

6. The apparatus according to claim 5, wherein the first region is a text/line region typified by text or a line, and the second region is a photographic region typified by a photograph.

7. The apparatus according to claim 6, wherein the first region includes also an equal-density large-area region comprising a plurality of pixels of equal density.

8. An image forming apparatus comprising:

an image carrier configured to carry an image;

a latent-image forming unit configured to form a latent image on said image carrier based upon image information;

a first developing unit configured to develop the latent image by a first toner;

a second developing unit configured to develop the latent image by a second toner which is of the same hue as that of the first toner and has a higher optical density than that of the first toner; and a control part configured to control said first and second developing units so as to form a first region, a second region and a third region on said image carrier, wherein the first region is one in which the second toner is used but the first toner is not used, the second region is one in which the first toner is used but the second toner is not used, and the third region is one in which at a boundary of the first and second regions, neither the first toner nor the second toner is used.

9. The apparatus according to claim 8, wherein the first region is a text/line region typified by text or a line, and the second region is a security-pattern region typified by a security-pattern.

10. The apparatus according to claim 9, wherein the first region includes also an equal-density large-area region comprising a plurality of pixels of equal density.

11. A method of controlling an image forming apparatus that includes:

an image carrier configured to carry an image;

a latent-image forming unit configured to form a latent image on said image carrier;

a first developing unit configured to develop the latent image by a first toner;

a second developing unit configured to develop the latent image by a second toner which is of the same hue as that of the first toner and has a higher optical density than that of the first toner;

said method comprising the step of controlling said first and second developing units so as to form a first region, a second region and a third region on said image carrier, wherein the first region is one in which the second toner is used but the first toner is not used, the second region is one in which the first and second toners are used, and the third region is one in which at a boundary of the first and second regions, neither the first toner nor the second toner is used.

12. A method of controlling an image forming apparatus that includes:

an image carrier configured to carry an image;

a latent-image forming unit configured to form a latent image on said image carrier;

a first developing unit configured to develop the latent image by a first toner;

a second developing unit configured to develop the latent image by a second toner which is of the same hue as that of the first toner and has a higher optical density than that of the first toner;

said method comprising the step of controlling said first and second developing units so as to form a first region, a second region and a third region on said image carrier, wherein the first region is one in which the second toner is used but the first toner is not used, the second region is one in which the first toner is used but the second toner is not used, and the third region is one in which at a boundary of the first and second regions, neither the first toner nor the second toner is used.

* * * * *